US008147382B2

(12) United States Patent
Eldridge

(10) Patent No.: US 8,147,382 B2
(45) Date of Patent: Apr. 3, 2012

(54) PHYSICAL TRAINING SYSTEM

(76) Inventor: Mark Eldridge, Brasher Falls, NY (US)

( * ) Notice: Subject to any disclaimer, the term of this patent is extended or adjusted under 35 U.S.C. 154(b) by 146 days.

(21) Appl. No.: 12/765,157

(22) Filed: Apr. 22, 2010

(65) Prior Publication Data

US 2010/0273608 A1 Oct. 28, 2010

Related U.S. Application Data

(60) Provisional application No. 61/171,533, filed on Apr. 22, 2009.

(51) Int. Cl.
*A63B 71/00* (2006.01)

(52) U.S. Cl. ..... 482/5; 482/1; 482/124

(58) Field of Classification Search ..... 482/1–9, 482/51, 54, 57, 69, 70, 92–103, 121–130, 482/900–902; 434/247, 254
See application file for complete search history.

(56) References Cited

U.S. PATENT DOCUMENTS

| | | | | |
|---|---|---|---|---|
| 5,391,080 | A * | 2/1995 | Bernacki et al. | 434/254 |
| 5,586,962 | A * | 12/1996 | Hallmark | 482/129 |
| 7,651,442 | B2 * | 1/2010 | Carlson | 482/8 |
| 7,850,578 | B2 * | 12/2010 | Balaker et al. | 482/70 |
| 2006/0199711 | A1 * | 9/2006 | Miers | 482/124 |

* cited by examiner

*Primary Examiner* — Glenn Richman
(74) *Attorney, Agent, or Firm* — Aidenbaum Schloff and Bloom PLLC; Jay Schloff

(57) ABSTRACT

A physical training system comprises a resistance structure, and at least one resistance unit disposed thereon, wherein an athlete may attach to the resistance unit by way of a cable that is incorporated in the resistance unit. The at least one resistance unit may exert a resistive force on an athlete through the cable. The system may further comprise at least one target object, against which an athlete may make selective physical contact as part of a training regimen. The system may further comprise sensors and data collection devices for tracking an athlete's performance. The system allows the exertion of force on an athlete from a plurality of directions and according to various movement patterns (including non-linear movement patterns) of an athlete.

12 Claims, 3 Drawing Sheets

PHYSICAL TRAINING SYSTEM

CROSS REFERENCE TO RELATED APPLICATIONS

The present disclosure claims priority under 35 United States Code, Section 119 on the U.S. Provisional Patent Application No. 61/171,533 filed on Apr. 22, 2009, the disclosure of which is incorporated by reference.

FIELD OF THE DISCLOSURE

The present disclosure generally relates to physical training systems, and more particularly, to a training system for training an athlete.

BACKGROUND OF THE DISCLOSURE

People nowadays have utmost conscious about their physical fitness. Specifically, persons such as athletes follow regular and structured exercise regimens to maintain their physical fitness. Generally, an athlete undergoes an exercise regimen for developing and improving upon physical characteristics such as speed, power, quickness, agility and endurance. Athletes can develop and improve such physical characteristics by overloading their muscles through resistive forces as part of an exercise regimen.

Typically, the athlete follows the exercise regimen by using a variety of exercise machines to improve his or her physical condition. Examples of the exercise machines may include a treadmill or a bungee cord-based exercise machine. These exercise machines, and the treadmill for example, use a rotary potentiometer installed on a console on a front section of the treadmill. The athlete may run on a conveyor belt of the treadmill, and speed of the conveyor belt may be controlled by the rotary potentiometer. However, the only resistive force provided by the treadmill is due to an incline or decline of a platform of the treadmill, to which platform the conveyor belt is attached. The athlete may change the effort level associated with the exercise regimen by changing the inclination of the platform, thereby varying the resistive forces offered by the treadmill However, such treadmills apply resistive forces of a limited range only and in limited directions to the athlete.

Another exercise machine utilized for athletic training is a bungee cord-based exercise machine. The exercise regimen utilizing such exercise machine may include performing a drill that hooks up the athlete to a bungee cord and allows the athlete to run away from a bungee base where the bungee cord is fixed. The bungee cord applies the resistive force on the athlete when the bungee cord is pulled out. However, when the bungee cord pulls the athlete backward towards the bungee base, the movement of the athlete and the resistive force applied by the bungee cord are in same direction.

Therefore, the existing exercise machines are accustomed to provide resistive forces in limited directions only. Specifically, these exercise machines do not provide resistive forces against various movement patterns of the athlete in all directions.

It is important to maintain proper kinetics of movement during the undertaking of the exercise regimen, as a particular athlete may have particular body needs and capabilities that are to be addressed by the exercise regimen and a particular tolerance or endurance with respect to the exercise regimen. However, existing exercise machines do not provide the option of adjusting a resistive force applied on a particular athlete, whether according to the individual's bodily need or the tolerance and endurance capability of the individual athlete. Furthermore, the athlete may require regular feedback on his/her performance, i.e., any progress or changes with respect to the physical characteristics, which may motivate the athlete to adhere to or make changes in the exercise regimen. However, existing exercise machines fail to track the performance of the athlete while following the exercise regimen on these exercise machines.

Accordingly, there exists a need for a training system that can train the athlete for speed, power, quickness, agility and endurance. Furthermore, there is a need for a technique for facilitating resistive forces against various movement patterns of the athlete in all directions. Furthermore, the athlete should be able to adjust an amount of resistive force applied by the training system while following an exercise regimen, and to track his/her performance related to the physical characteristics as a result of following the exercise regimen.

Therefore, it is an object of the present disclosure to obviate the above and other disadvantages from existing art and to provide a training system that can apply resistive force to an athlete irrespective of movement patterns of the athlete.

It is further an object of the present disclosure to provide a feasibility of adjusting resistive force applied by the training system for providing training based on the bodily need and tolerance of the athlete.

It is further an object of the present disclosure to provide a training system capable of tracking performance of the athlete with respect to speed, power, quickness, agility and endurance while following an exercise regimen on the training system.

SUMMARY OF THE DISCLOSURE

The present disclosure provides a training system to train a person (and especially an athlete) in achieving and improving on physical characteristics such as speed, power, quickness, agility and endurance while doing actual physical movements. The training system is capable of providing resistive forces against various movement patterns of the athlete, such as forward, backward, side-to-side and circular movement. More specifically, the training system provides resistive force to the athlete in a direction opposite to every direction of movement of the athlete.

The training system includes a resistance structure and at least one resistance unit, which resistance unit may, for example, comprise a motor-driven cable or a spring-rewind pulley arrangement. The at least one resistance unit, and preferably, a plurality of resistance units, is coupled to the resistance structure. The at least one resistance unit is capable of providing resistance upon an athlete using the training system, from various directions through the resistance units. Resistance units may be disposed on the resistance structure in a circular square, triangular, rectangular, or patterns.

Each of the resistance units is capable of providing a resistive force to the athlete by using cables or belts, for example. The athlete may have the cables or belts hooked up to his/her body through a suitable harness system. The resistance units provide the resistive forces against various movement patterns of the athlete within a boundary of the resistance unit. The athlete may move either towards or away from one or more resistance unit of the resistance units, when the athlete moves in a particular movement pattern. In such a case, some of the resistance units may produce a minimum resistive force on the athlete, while other resistance units may provide significant resistive forces in the directions opposite to the athlete's movement patterns of the athlete. From individual rewind and resistance forces of the resistance units, the athlete may encounter resistance at all positions and orientations in his/her movement patterns.

The resistance force or forces applied by the resistance unit may be controlled by using suitable mechanisms. Such as a drive, a programmable logic controller, a touch screen panel mate, a personal computer, and the like. The system may further comprise data collection devices, which devices, on account of the various movement patterns an athlete may undertake, allows the system to collect data associated with an athlete's non-linear movement patterns.

These together with other aspects of the present invention, along with the various features of novelty that characterize the invention, are pointed out with particularity in the claims annexed hereto and forming a part of this invention. For a better understanding of the present invention, its operating advantages, and the specific objects attained by its uses, reference should be made to the accompanying drawings and descriptive matter in which, there are illustrated exemplary embodiments of the present invention.

DESCRIPTION OF THE DRAWINGS

The advantages and features of the present disclosure will become better understood with reference to the detailed description taken in conjunction with the accompanying drawings, wherein like elements are identified with like symbols, and in which.

Like reference numerals refer to like parts throughout the description of several views of the drawings.

DETAILED DESCRIPTION OF THE DISCLOSURE

Figure 1:
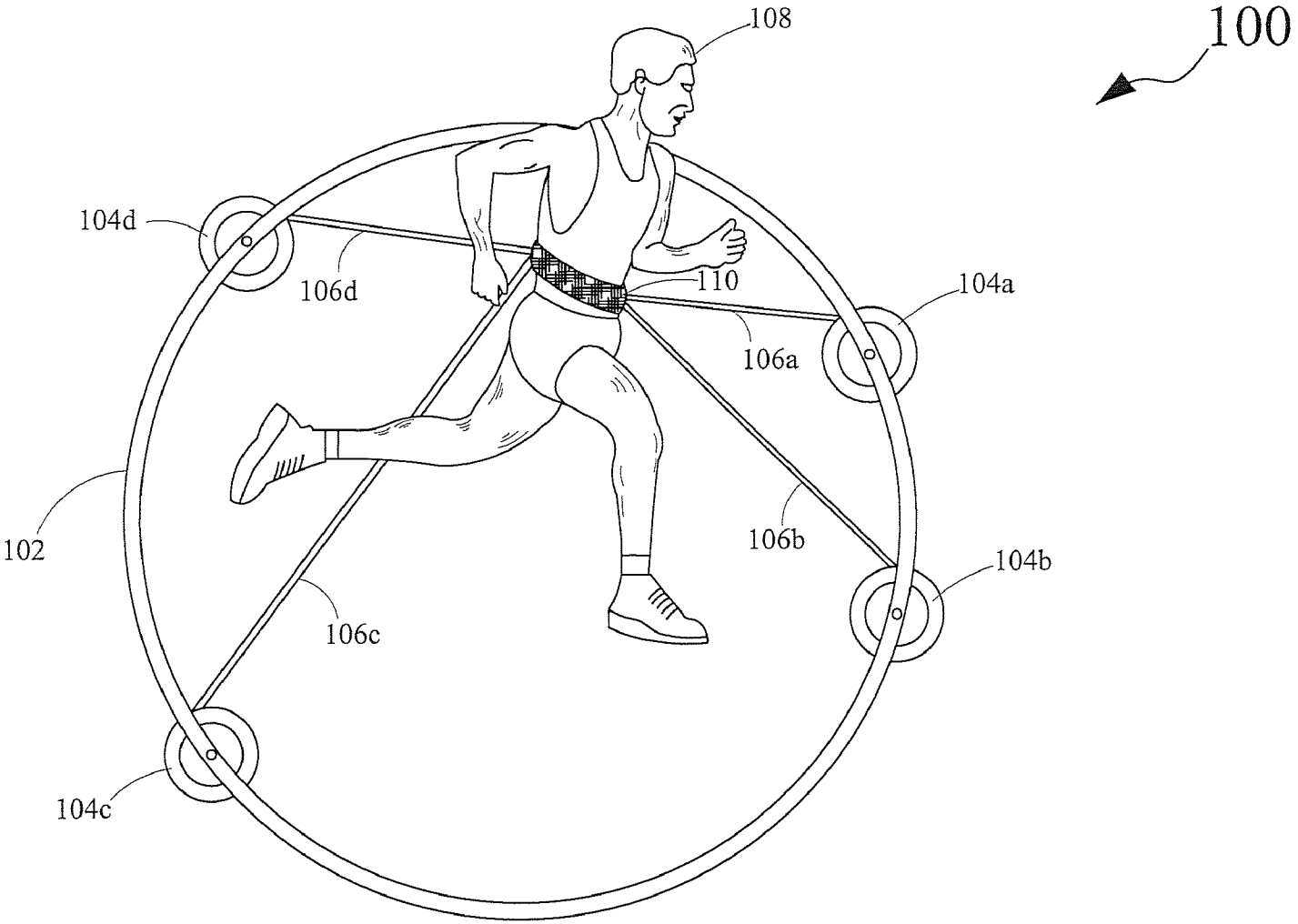
FIG. 1 illustrates an exemplary training system, in accordance with an embodiment of the present disclosure.
Figure 2:
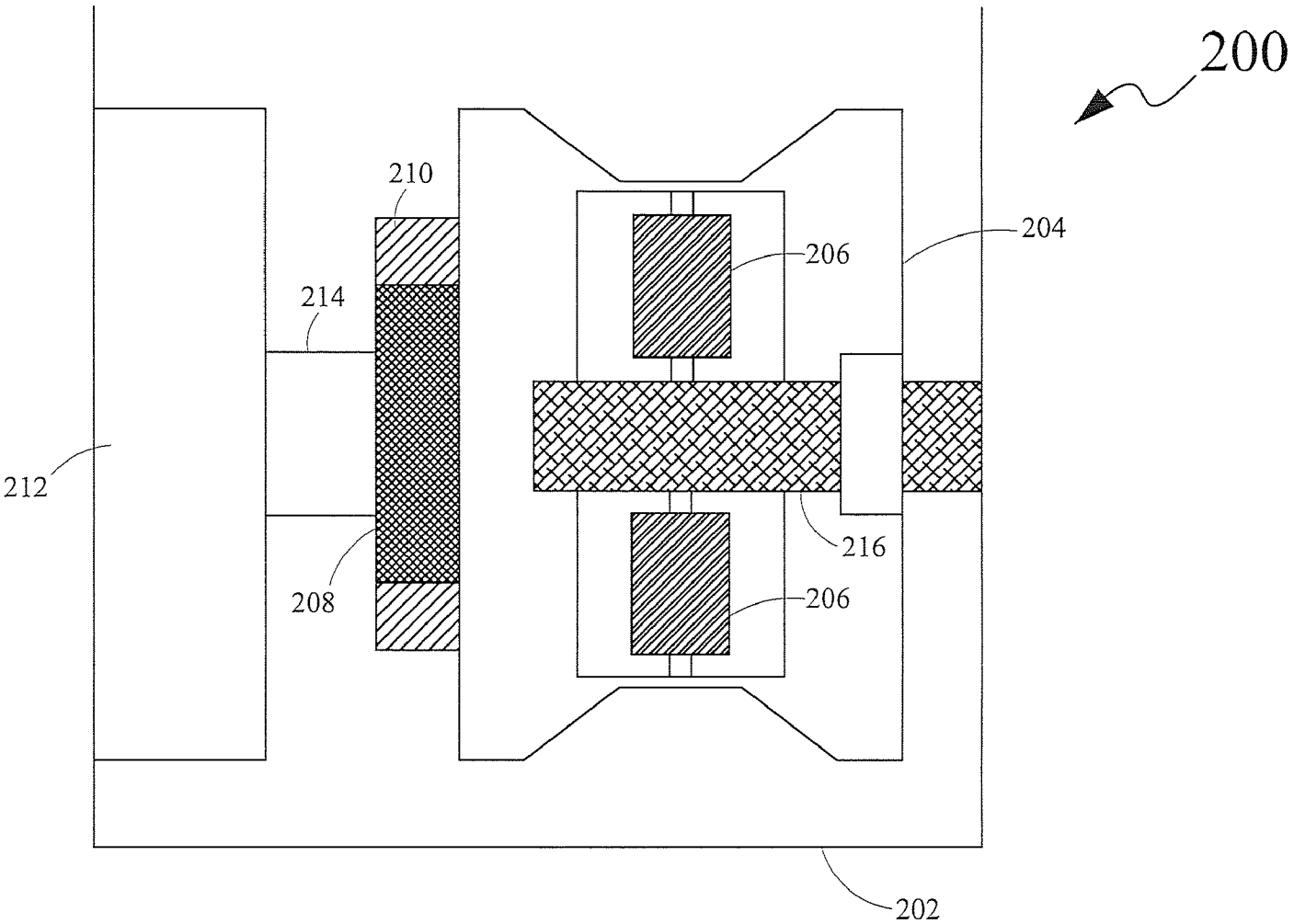
FIG. 2 illustrates a schematic view of a resistance unit of the training system of FIG. 1, in accordance with an embodiment of the present disclosure.

The best mode for carrying out the present disclosure is presented in terms of its preferred embodiment(s), herein depicted in FIGS. 1 and 2. The preferred embodiment described herein detail for an illustrative purpose is subject to many variations. It is understood that various omissions and substitutions of equivalents are contemplated as circumstances may suggest or render expedient, but are intended to cover the application or implementation without departing from the spirit or scope of the present disclosure.

The terms "a" and "an" herein do not denote a limitation of quantity, but rather denote the presence of at least one of the referenced item.

The present disclosure provides a training system to train a person (and especially an athlete) in achieving and improving on physical characteristics such as speed, power, quickness, agility and endurance while doing actual physical movements. The training system is capable of providing resistive forces against various movement patterns of the athlete, such as forward, backward, side-to-side and circular movement. More specifically, the training system provides resistive force to the athlete in a direction opposite to every direction of movement of the athlete.

Figure 3:
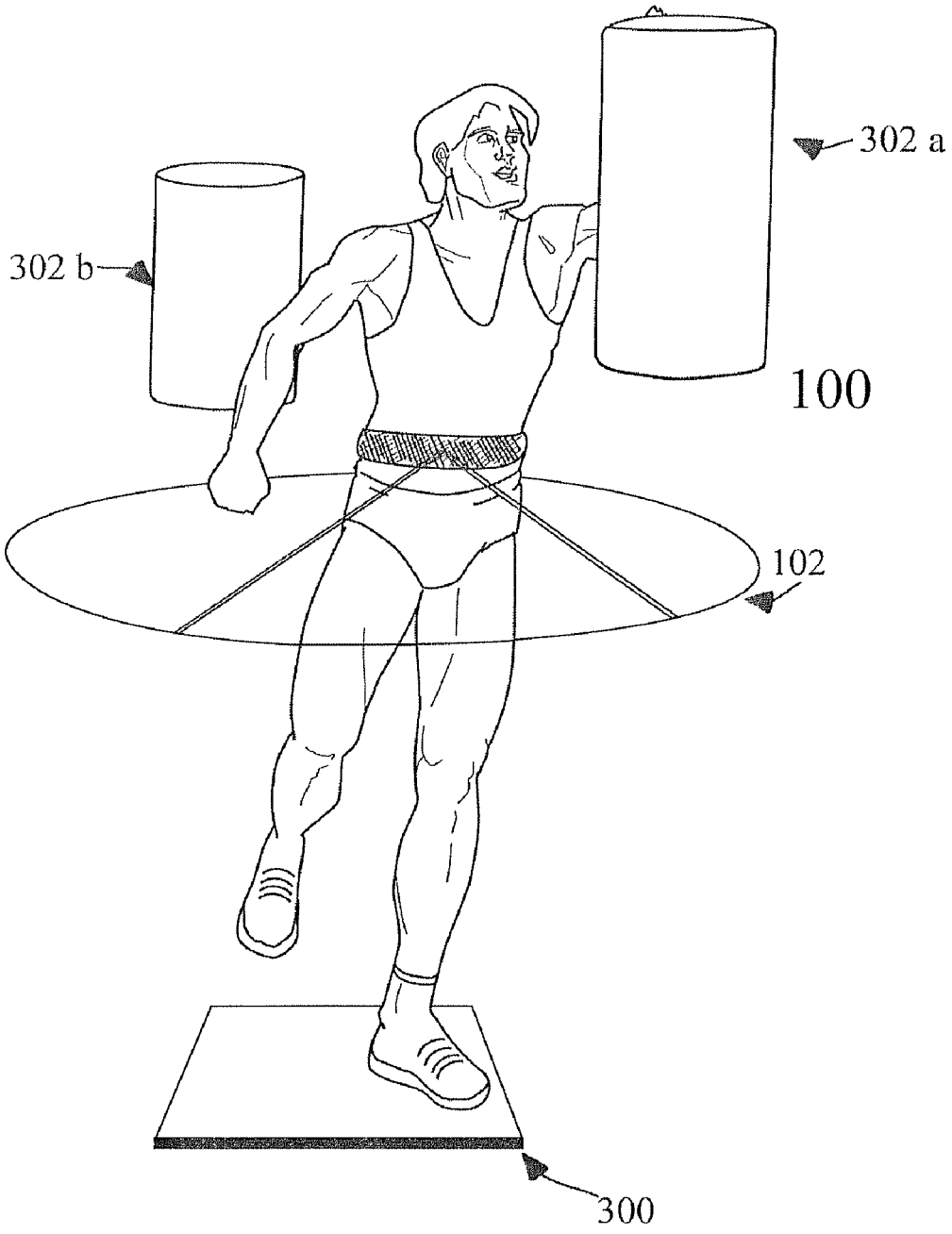
FIG. 3 illustrates and exemplary training system, in accordance with another embodiment of the present disclosure.

FIGS. 1, 2, and 3 illustrate a training system, in accordance with an embodiment of the present disclosure. More specifically, FIG. 1 illustrates an exemplary training system, in accordance with an embodiment of the present, FIG. 2 illustrates a schematic view of a resistance unit of the training system of FIG. 1, in accordance with an embodiment of the present disclosure, and FIG. 3 illustrates and exemplary training system, in accordance with another embodiment of the present disclosure.

FIG. 1 shows the training system 100 that includes a resistance structure 102. The training system 100 includes resistance units 104*a*, 104*b*, 104*c*, and 104*d* (hereinafter referred to as "the resistance units 104") coupled to the resistance structure 102. The resistance structure 102 is capable of providing resistance in multiple directions or vectors, to an athlete 108 using the training system 100, from various directions through the resistance units 104. The training system 100 may serve as a single machine for providing resistive forces in directions opposite to directions of movement of the athlete 108.

The resistance structure 102 is shown as having a circular pattern, which should not be considered limiting, as the resistance structure 102 may also have square, triangular, rectangular, and other pattern. Each of the resistance units 104 is capable of providing a resistive force on the athlete 108 way of cables or belts, for example. In this exemplary embodiment of the present disclosure, the training system 100 includes a plurality of cables such as a cable 106*a*, a cable 106*b*, a cable 106*c*, and a cable 106*d* (hereinafter collectively termed as 'cables 106'). The athlete 108 may have the cables 106 connected to his/her body through a suitable harness system, such as a harness system 110. The harness system 110 may include hooks, a belt, and the like, which may be removably attached to the body of the athlete 108. Further, the harness system 110 is adapted to allow the cables 106 to be attached to the body of the athlete 108. In an exemplary representation of FIG. 1, it is shown that the resistance units 104*a*, 104*b*, 104*c* and 104*d* are attached to the body of the athlete 108 via the cable 106*a*, 106*b*, 106*c* and 106*d* respectively, however, this representation should not be considered limiting to the scope of the present disclosure.

The resistance units 104 provide the resistive forces against various movement patterns of the athlete 108 within a boundary of the resistance structure 102 (for example, backward movement, forward movement, side-to-side movement or movement in a circular pattern.) For example, if the athlete 108 moves away from resistance units, such as the resistance units 104*c* and 104*d*, the cables 106*c* and 106*d* are pulled in a direction away from the resistance units 104*c* and 104*d*. Such state of the resistance units 104*c* and 104*d*, when the cables 106*c* and 106*d* are pulled out may be termed as 'unwinding states'. The unwinding state of a resistance unit denotes that the resistance unit is in resistance mode and is applying a resistive force on a cable, wherein such resistive force tends to oppose the pulling out of the cable. As the athlete 108 moves towards resistance units such as the resistance units 104*a* and 104*b* (as shown), the resistance units 104*a* and 104*b* are in a rewind mode and may produce a minimal force on the athlete 108.

Further, the athlete 108 may either move towards or away from one or more resistance unit of the resistance units 104, when the athlete 108 moves in various movement patterns. Therefore, some of the resistance units 104 may be in the rewind mode and will produce a very low force on the athlete 108. At the same time, other remaining resistance units of the resistance units 104 may be in the unwinding states (i.e., in a state that provides comparatively higher resistance on the athlete) and thereby produce significant resistive forces in the directions opposite to the movement patterns of the athlete 108. Due to the rewind modes and the resistance modes of the resistance units 104, the athlete 108 may encounter resistance from various directions with respect to his/her movement pattern.

In an exemplary representation in FIG. 1, the athlete 108 is moving towards the resistance units 104*a* and 104*b* and away from the resistance units 104*c* and 104*d*. It would be apparent to those skilled in the art that the athlete 108 may undertake any movement pattern within the boundary of the resistance structure 102 and will experience the resistive forces in opposition to such movement patterns. Further, it would be apparent to those skilled in the art that the athlete 108 may develop or improve his/her physical characteristics by following different movement patterns. Furthermore, the present disclosure provides control mechanisms to vary the level of the resistive force applied on the athlete 108 by the resistance units 104. Such control mechanisms include, but are not necessarily limited to clamps, brakes, motors, and the like, and it will be apparent to one skilled in the art that the system disclosed herein with further comprise control units for such control mechanisms. Such control mechanisms may allow a user to vary the resistance by reducing it or increasing it in discrete bursts or at a constant rate. An exemplary resistance unit that may be used in the training system 100 is described in conjunction with FIG. 2.

Referring now to FIG. 2, a schematic view of a resistance unit 200 is shown, according to an embodiment of the present disclosure. The resistance unit 200 may be used as a resistance unit of the resistance units 104, as explained in conjunction with FIG. 1. The resistance unit 200 includes a frame 202 for providing support to various components of the resistance unit 200. In an embodiment, the resistance unit 200 includes a rewind pulley 204, a spring 206 attached to the rewind pulley 204, a one way bearing 208, a coupling 210 to attach the one-way bearing 208 to the rewind pulley 204, a device 212, a brake shaft 214, and a supporting shaft 216 that provides support to the rewind pulley 204. It will be understood that the resistance unit may, in another embodiment, comprise a motor or other mechanism or device that is capable of releasing and rewinding the cable and of providing resistive force of varying magnitudes as a result.

A cable such as the cable 106*c* may be operatively coupled to the rewind pulley 204. More specifically, the cable may be rolled over the rewind pulley 204 and a rotation of the rewind pulley 204 may allow the cable to be pulled out of the rewind pulley 204. The rewind pulley 204 is connected to the device 212 through the brake shaft 214. The device 212 may include, but is not restricted to, an electromagnetic brake (hereinafter referred to as "the brake 212"). The brake 212 has the brake shaft 214 extending outwardly from the brake 212. Further, the brake shaft 214 is operatively coupled to the rewind pulley 204 through a one way bearing 208 that is fit over the brake shaft 214. The one way bearing 208 is pressed into the coupling 210 that may be attached to a side of the rewind pulley 204. The one way bearing 208 may include, but is not restricted to, a sprag bearing, a clutch bearing, and the like. The brake 212 may be configured to provide torque on the brake shaft 214 when the brake shaft 214 makes a rotation on its axis.

The resistance unit 200 may be attached to the athlete 108 via a cable (not shown) such as the cable 106*c*. Further, when the cable is pulled out of the rewind pulley 204 (in the event the athlete 108 moves away from the resistance unit 200), the one way bearing 208 engages and locks onto the brake shaft 214, thereby forcing the brake shaft 214 to rotate. This enables the brake 212 to produce resistive force on the cable. Further, as the cable is pulled out, the spring 206 inside the rewind pulley 204 starts winding more tightly.

When the cable stops being pulled out of the rewind pulley 204 or in the event that the athlete 108 moves towards the resistance unit 200, the one way bearing 208 disengages the brake shaft 214. Further, the spring 206 that is wound causes the rewind pulley 204 to rewind in the opposite direction such that the cable starts rolling over the rewind pulley 204. More specifically, the brake shaft 214 does not spin, however, the rewind pulley 204 spins around the brake shaft 214. Accordingly, in such a case, the rewind pulley 204 rotates in a direction opposite to the direction associated with when the cable was being pulled out (i.e., away from the resistance unit 200). This allows the cable to rewind with only minimal tension or pull. The minimal tension or pull is a minimal resistive force (which is less in magnitude) that may be produced by the release of the spring 206. Therefore, it would be apparent to those skilled in the art that the resistance unit 200 may produce a comparatively higher resistive force (through the brake 212) in one direction, when the athlete 108 moves away from the resistance unit 200 and the minimal resistive force when the athlete 108 moves towards the resistance unit 200.

Further, the resistive force applied by the resistance unit 200 may be controlled by using suitable mechanisms. Preferably, the mechanisms may involve use of components such as a drive, a programmable logic controller (PLC), a touch screen panel, a personal computer (PC), and the like. These components may be connected to the resistance unit 200 by electrical means. Further, such mechanisms may include a programming option that allows the athlete 108 to set the resistive force applied by each of the resistance units individually or for any combination of the resistance units. For example, the athlete 108 may set a common setting of the resistive forces for more than one resistance unit. Furthermore, the programming option may also allow the athlete 108 to control the speed at which the cable is pulled out of the resistance unit 200. The programming option control mechanisms may allow a user (i.e., a coach observing the athlete's performance) or the athlete 108 to vary the resistive force by reducing it or increasing it in discrete segments or at a constant rate, or by applying and ceasing the force selectively and/or in a consistent pattern.

The training system 100 may further provide an option for the athlete 108 to include data collection devices such as potentiometers, accelerometers, line tension reading devices, strain gages, load cells, force plates and the like. The data collections devices may be used to collect, store, chart, graph, and print out of a performance data of the athlete 108. Herein, the performance data may be any information related to the exercise regimen of the athlete 108 on the training system 100. The performance data may be collected with respect to various settings of the resistance unit 200, such as the tension level, speed of the cable pull-out, etc., as set by the athlete 108. Due to the multi-directional movement patterns of an athlete 108 using the system, the data collected by the athlete may include data related to non-linear movement patterns.

It is to be noted that the design of the training system 100, is not limited to the exemplary configuration of the resistance unit 200 as described herein with respect to FIG. 2. Specifically, the components such as the brake 212, the rewind pulley 204, and operative coupling of the one way bearing 208 and the brake shaft 214 are shown for exemplary purposes only, and it should be apparent to those skilled in the art that other equivalent components having similar functionalities known in the art may be utilized in place of these components in the training system 100.

Referring now to FIG. 3, another embodiment of a training system 100 is shown. In this embodiment, the system 100 further comprises a platform 300 and at least one target object 302. The platform 300 may support the athlete 108 while the athlete 108 is using the system 100. It will be apparent to one skilled in the art that the platform 300 may be optional, and that the system 100 may be deployed such that the athlete 108 is supported by the floor of a gymnasium, or a track, or other existing surface. The platform may further comprise at least one sensor therein (not shown), such as force plates, which sensors may collect data related to an athlete's performance, including, for example, data related to an athlete's acceleration, deceleration, and speed, including acceleration, deceleration, and speed corresponding to non-linear movement patters.

The at least one target object 302 of the system may be disposed in sufficient proximity to the resistance structure 102 such that an athlete may make selective physical contact with the at least one target object 302. The at least one target object 302 may be supported on a separate structure or may be removably attached to the resistance structure 102. The at least one target object may be a tackling dummy (such as a tackling dummy 302*a* and tackling dummy 302*b* shown in FIG. 3), a punching bag, a barbell, a weight machine (such as a bench press machine), a medicine ball and trampoline, or any other exercise or physical training implement. The at least one target object 302 may further comprise at least one sensor therein or thereon, which at least one sensor may collect data related to an athlete's performance in response to the drill presented by the at least one target object. In an embodiment, a plurality of target objects 302 may be disposed equidistant from one another, and a user (such as a coach) may direct an athlete to make contact with each of the plurality of target objects 302 in a desired sequence as part of a training regimen.

The system 100 shown herein may be installed in an existing space, such as a gymnasium or field, such that the resistance structure 102 is incorporated and attached to elements in the existing space (such as walls or ceiling beams.) In another embodiment, the system 100 may be a stand-alone model that comprises a resistance structure 102 that may be erected in a space without a need of attachment to or support from elements in a space.

The described embodiments of the present disclosure may offer following advantages. The training system 100 is capable of providing the resistive forces in all directions opposite to the movement of the athlete 108 in order to train the athlete 108 for enhancing the physical characteristics such as speed, power, quickness, agility and for more endurance. Further, the training system 100 may be utilized for providing multi-directional resistance that allows the athlete 108 to duplicate actual athletic procedures. Moreover, the athlete 108 may be subjected to multiple resistive forces of various magnitudes at a time, from different directions, by varying the resistive forces from each resistance unit. Furthermore, the present disclosure provides the athlete 108 an option of controlling the resistive force of a particular resistance unit depending upon his/her needs, stamina, and/or tolerance. Furthermore, the athlete 108 using the training system 100 may also be able to collect performance data of the exercise regimen by using the training system 100. The performance data collected by the training system may include data regarding non-linear movements of an athlete.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A physical training system, the system comprising a resistance structure, and at least one resistance unit disposed thereon, wherein said at least one resistance unit is operatively coupled to an athlete; wherein the at least one resistance unit comprises a frame, a cable, a rewind pulley, a spring attached to said rewind pulley, a one-way bearing, a brake, a brake shaft, and a support shaft, wherein said cable attaches said resistance unit to an athlete; wherein said frame contains said rewind pulley, said spring, said one-way bearing, said brake, said brake shaft and said support shaft, wherein said cable is operatively coupled to said rewind pulley, wherein said rewind pulley is operatively coupled to said brake via said brake shaft, wherein said rewind pulley is operatively coupled to said brake shaft via said one way bearing, such that at least one resistance unit applies a greater resistive force on said cable when the cable moves away from said at least one resistance unit, and such that the at least one resistance unit applies a lesser resistive force on said cable when the cable moves toward said at least one resistance unit.

2. The physical training system of claim 1, wherein the at least one resistance unit comprises a frame, a cable, a rewind pulley, a spring attached to said rewind pulley, a one-way bearing, a brake, a brake shaft, and a support shaft, wherein said cable attaches said resistance unit to an athlete.

3. The at least one resistance unit of claim 2, wherein said frame contains said rewind pulley, said spring, said one-way bearing, said brake, said brake shaft and said support shaft, wherein said cable is operatively coupled to said rewind pulley, wherein said rewind pulley is operatively coupled to said brake via said brake shaft, wherein said rewind pulley is operatively coupled to said brake shaft via said one way bearing, such that at least one resistance unit applies a greater resistive force on said cable when the cable moves away from said at least one resistance unit, and such that the at least one resistance unit applies a lesser resistive force on said cable when the cable moves toward said at least one resistance unit.

4. The physical training system of claim 1, wherein said system further comprises a control mechanism.

5. The physical training system of claim 4, wherein said control mechanism comprises a drive, a programmable logic controller, a touch screen panel, and a computer.

6. The physical training system of claim 4, wherein said control mechanism is operatively coupled with the at least one resistance unit.

7. The physical training system of claim 1, wherein said system further comprises at least one sensor.

8. The physical training system of claim 1, wherein said at least one sensor is disposed on the at least one resistance unit.

9. The physical training system of claim 1, wherein said system further comprises at least one target object.

10. The physical training system of claim 9, wherein said at least one target object comprises at least one sensor.

11. The physical training system of claim 1, wherein said system further comprises at least one data collection device.

12. The physical training system of claim 1, comprising a first resistance unit and a second resistance unit, wherein said first resistance unit and said second resistance unit are disposed on said resistance structure such that said first resistance unit and said second resistance unit are equidistant from one another.

* * * * *